US007670740B2

(12) United States Patent
Wu et al.

(10) Patent No.: US 7,670,740 B2
(45) Date of Patent: Mar. 2, 2010

(54) PHOTOCONDUCTORS CONTAINING FILLERS

(75) Inventors: Jin Wu, Webster, NY (US); Daniel V. Levy, Rochester, NY (US); Liang-Bih Lin, Rochester, NY (US); Lin Ma, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 337 days.

(21) Appl. No.: 11/811,455

(22) Filed: Jun. 11, 2007

(65) Prior Publication Data

US 2008/0305415 A1 Dec. 11, 2008

(51) Int. Cl.
*G03G 15/02* (2006.01)

(52) U.S. Cl. ..... 430/66; 430/58.1; 430/58.6; 430/58.8; 430/59.4

(58) Field of Classification Search ..... 430/66, 430/67, 58.1, 58.05, 58.6, 58.8, 59.4
See application file for complete search history.

(56) References Cited

U.S. PATENT DOCUMENTS 4,766,048 A * 8/1988 Hisamura ..... 430/58.05
5,473,064 A 12/1995 Mayo et al.
5,482,811 A 1/1996 Keoshkerian et al.
5,489,496 A 2/1996 Katayama et al.
6,177,219 B1 1/2001 Yuh et al.
6,218,062 B1 4/2001 Yuh et al.
6,261,729 B1 * 7/2001 Yuh et al. ..... 430/65
6,326,112 B1 12/2001 Tamura et al.
6,562,531 B2 5/2003 Niimi
2008/0241720 A1 * 10/2008 Wu et al. ..... 430/58.8

OTHER PUBLICATIONS

See the "Cross Reference to Related Applications" on p. 1 of the Specification Being Filed Concurrently.
John F. Yanus et al., U.S. Appl. No. 11/593,875 on Silanol Containing Overcoated Photoconductors, filed Nov. 7, 2006.
Jin Wu et al., U.S. Appl. No. 11/729,622 on Anticurl Backside Coating (ACBC) Photoconductors, filed Mar. 29, 2007.

* cited by examiner

*Primary Examiner*—John L Goodrow
(74) *Attorney, Agent, or Firm*—E. O. Palazzo

(57) ABSTRACT

A photoconductor that includes, for example, a supporting substrate, a photogenerating layer, at least one charge transport layer comprised of at least one charge transport component, and an overcoating layer in contact with and contiguous to the top charge transport layer, and which overcoating is comprised of a polymer, an optional overcoating charge transport component, and needle shaped particles with an aspect ratio of from 2 to about 200.

33 Claims, No Drawings

PHOTOCONDUCTORS CONTAINING FILLERS

CROSS REFERENCE TO RELATED APPLICATIONS

U.S. application Ser. No. 11/811,465, U.S. Publication No. 20080305416, filed Jun. 11, 2007, the disclosure of which is totally incorporated herein by reference, on Photoconductors Containing Fillers in the Charge Transport, by Jin Wu et al.

U.S. application Ser. No. 11/811,548, U.S. Publication No. 20080305414, filed Jun. 11, 2007, the disclosure of which is totally incorporated herein by reference, on Single Layered Photoconductors Containing Needle Shaped Particles, by Jin Wu et al.

Illustrated in U.S. application Ser. No. 11/729,622, U.S. Publication No. 20080241720, the disclosure of which is totally incorporated herein by reference, filed Mar. 29, 2007 on Anticurl Backside Coating (ACBC) Photoconductors by Jin Wu et al., is a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

The appropriate components, such as the supporting substrates, the photogenerating layer components, the hydroxygallium phthalocyanines prepared as illustrated herein, the charge transport layer components, the overcoating layer components, and the like, may be selected for the photoconductors of the present disclosure in embodiments thereof.

BACKGROUND

This disclosure is generally directed to layered imaging members, photoreceptors, photoconductors, and the like. More specifically, the present disclosure is directed to multilayered drum, or flexible, belt imaging members, or devices comprised of a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an overcoating layer, and wherein the overcoating contains a filler, which filler primarily functions to extend the photoconductor life. Also, more specifically the photoconductors disclosed contain a top layer, such as a layer that includes a filler, or where the charge transport layer is the top layer, and such layer contains filler. Yet more specifically, the uppermost layer or top layer of the photoconductor can be comprised of a polymer, an optional charge transport component, and needle shaped particles, such as silica, titania, alumina, fluorinated polymers, such as polytetrafluoroethylene (PTFE), polyvinylfluoride (PVDF), and the like, and where the needle shaped particles possess an aspect ratio (length/diameter) of about equal to 2 or in excess of 2, such as from about 2 to about 100, from about 2.5 to about 75, and from about 3 to about 50. Yet more specifically, the uppermost layer or top layer of the photoconductor can be comprised of the components as illustrated in copending U.S. application Ser. No. 11/593,875, the disclosure of which is totally incorporated herein by reference, and needle shaped particles. Thus, the overcoating layer in contact with and contiguous to the charge transport layer can be comprised of an acrylated polyol, a polyalkylene glycol, a crosslinking agent, a charge transport component, and needle shaped particles.

Further, in embodiments the photoconductors disclosed can be comprised of a supporting substrate, a photogenerating layer, and at least one charge transport layer, and where needle shaped particles are incorporated into the charge transport layer. Also disclosed are single layered photoconductors comprised of at least one photogenerating pigment, a charge transport component, an optional resin binder, and needle shaped particles. Moreover, in embodiments the photoconductors illustrated herein can contain an ACBC (anticurl backside coating) layer on the reverse side of the supporting substrate of a belt photoreceptor. The ACBC layer, which can be solution coated, for example, as a self-adhesive layer on the reverse side of the substrate of the photoconductor, may comprise a number of suitable materials such as those components that do not substantially effect surface contact friction reduction, and prevent or minimize wear/scratch problems for the photoconductor. Examples of anticurl back coating formulations are disclosed in copending U.S. application Ser. No. filed May 31, 2007, the disclosure of which is totally incorporated herein by reference, on Photoconductors, by Kathy L. DeJong et al.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductors belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. The photoconductors are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Illustrated in U.S. Pat. No. 6,177,219 is a photoreceptor comprising: (a) a substrate; (b) a charge blocking layer including a binder, a plurality of grain shaped n-type particles, and a plurality of needle shaped n-type particles, wherein the grain shaped particles have a higher concentration in the blocking layer than the needle shaped particles; and (c) an imaging layer.

Illustrated in U.S. Pat. No. 6,218,062 is a photoreceptor including: (a) a substrate; (b) a charge generating layer including a binder, a n-type charge generating material, and a plurality of needle shaped n-type particles; and (c) a charge transport layer, wherein the charge generating layer and the charge transport layer are in any sequence over the substrate, reference the Abstract of this patent.

There are illustrated in U.S. Pat. No. 6,562,531 photoconductors with protective layers containing spherical shaped fillers, such as fillers with, for example, specific average diameter particles, and certain resistivities, such as alumina, metal oxides, polytetrafluoroethylene, silicone resins, amorphous carbon powders, powders of metals like copper, tin, and the like.

Disclosed in U.S. Pat. No. 6,326,112 is the incorporation of alumina in a charge transport layer, and which alumina is of an average particle diameter of from 0.01 to 0.5 micron.

In U.S. Pat. No. 5,489,496 there are disclosed photoconductors with needle like titanium oxide particles contained in the undercoating layer.

A number of layered photoconductors have been described in numerous U.S. patents, such as U.S. Pat. No. 4,265,990, the disclosure of which is totally incorporated herein by reference, wherein there is illustrated a photoconductor comprised of a photogenerating layer, and an aryl amine hole transport layer. Examples of disclosed photogenerating layer components include trigonal selenium, metal phthalocyanines, vanadyl phthalocyanines, and generally metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,587,189, the disclosure of which is totally incorporated herein by reference, there is illustrated a layered imaging member with, for example, a perylene pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

SUMMARY

Disclosed are improved photoconductors with, for example, extended life times as compared to a number of known photoconductors that do not contain fillers, and where extended lifetimes refers to in excess, it is believed, of about 1,000,000 simulated imaging cycles, and which photoconductors also possess excellent electrical characteristics.

Additionally disclosed are improved flexible belt imaging members with a hole blocking layer comprised of, for example, amino silanes, metal oxides, phenolic resins, and optional phenolic compounds, and which phenolic compounds contain at least two, and more specifically, 2 to 10 phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor comprising an optional first ACBC layer, a flexible supporting substrate thereover, a photogenerating layer, at least one charge transport layer comprised of at least one charge transport component, and an overcoat layer that includes needle shaped fillers or particles, and wherein the first layer, which is an anticurl back coating (ACBC) is in contact with the supporting substrate on the reverse side thereof, and which first layer and/or other layers of the photoconductors include needle like particles with, for example, an aspect ratio (length/diameter) of at least 2, and more specifically, from more than 2 to about 200, from about 5 to about 100, and more specifically, from about 10 to about 40; a photoconductor comprising a supporting substrate, a photogenerating layer, and a charge transport layer comprised of at least one charge transport component, and thereover an overcoating that includes needle shaped particles with certain aspect ratios; a photoconductor which includes a hole blocking layer and an adhesive layer where the adhesive layer is situated between the hole blocking layer and the photogenerating layer, and the hole blocking layer is situated between the substrate and the adhesive layer, and where needle shaped particles are incorporated in the top overcoating layer; a photoconductor comprising a supporting substrate, a photogenerating layer, at least one charge transport layer comprised of at least one charge transport component, and an overcoating layer in contact with and contiguous to the top charge transport layer, and which overcoating layer is comprised of a polymer, a charge transport component, and needle shaped particles with an aspect ratio of from 2 to about 200; a photoconductor comprised in sequence of a supporting substrate, a photogenerating layer thereover, a charge transport layer, and an overcoating layer in contact with and contiguous to the charge transport layer, and which overcoating is comprised of a polymer selected from the group consisting of polycarbonates, polyarylates, acrylate polymers, vinyl polymers, cellulose polymers, polyesters, polysiloxanes, polyamides, polyurethanes, poly(cyclo olefins), epoxies, and a crosslinked polymeric system of an acrylated polyol, a polyalkylene glycol, a crosslinking agent, an optional overcoating charge transport component and needle shaped additive particles substantially free of spherical particles, and which needle shape particles possess an aspect ratio of from about 3 to about 150; and a photoconductor comprised, for example, in sequence of a supporting substrate, a photogenerating layer thereover, a charge transport layer, a protective overcoating layer in contact with the charge transport layer, and wherein the overcoating layer contains a filler with an aspect ratio of from about 3 to about 125, which filler is of a diameter of from about 0.001 to about 1 micron, and which filler is present in an amount of from about 5 to about 25 weight percent.

In embodiments, there are disclosed needle shaped particles that can be included in the charge transport layer and/or in a single layered photoconductor, and more specifically, there is disclosed a photoconductor comprising a supporting substrate, a photogenerating layer, at least one charge transport layer comprised of at least one charge transport component, and needle shaped particles with an aspect ratio of from 2 to about 200; a photoconductor comprised in sequence of a supporting substrate, a photogenerating layer thereover, and a charge transport layer comprised of a charge transport component and needle shaped filler particles substantially free of spherical particles, and which needle shaped particles possess an aspect ratio of from about 3 to about 150; a photoconductor comprised in sequence of a supporting substrate, a photogenerating layer thereover, and a charge transport layer comprised of a hole transport component, a resin binder, and a needle shaped filler with an aspect ratio of from about 3 to about 125, which filler is of a diameter of from about 0.001 to about 1 micron, and which filler is present in an amount of from about 1 to about 30 weight percent; a photoconductor comprising a supporting substrate, and a single layer thereover comprised of at least one photogenerating pigment, at least one charge transport component, and needle shaped particles with an aspect ratio of from 2 to about 200; a photoconductor comprised in sequence of a supporting substrate, and a single active layer comprised of a photogenerating pigment, a charge transport compound, needle shaped additive particles substantially free of spherical particles, and which needle shaped particles possess an aspect ratio of from about 3 to about 150, and an optional electron transport compound; a photoconductor comprised of a supporting substrate, and a mixture of at least one photogenerating pigment, a hole transport component, a resin binder, and needle shaped fillers with an aspect ratio of from about 3 to about 125, which filler is of a diameter of from about 0.001 to about 1 micron, and which filler is present in an amount of from about 1 to about 20 weight percent; a photoconductor comprising a supporting substrate, a photogenerating layer, at least one charge transport layer comprised of at least one charge transport component, and an overcoating layer in contact with and contiguous to the top charge transport layer, and which overcoating layer is comprised of a polymer, and needle shaped particles with an aspect ratio of from 2 to about 200; a photoconductor comprised in sequence of a supporting substrate, a photogenerating layer thereover, a charge transport layer, and an overcoating layer in contact with and contiguous to the charge transport layer, and which overcoating is comprised of a polymer selected from the group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof, and a crosslinked polymeric network of an acrylated polyol, a polyalkylene glycol, a crosslinking agent, a charge transport component and needle shaped additive particles substantially free of spherical particles, and which needle shaped particles possess an aspect ratio of from about 3 to about 150; and a photoconductor comprised in sequence of a supporting substrate, a photogenerating layer thereover, a charge transport layer, a protective overcoating layer in contact with the charge transport layer, and wherein the overcoating layer contains a filler with an aspect ratio of from about 3 to about 125, which filler is of a diameter of from about 0.001 to about 1 micron, and which filler is present in an amount of from about 1 to about 30 weight percent.

Examples of needle shaped additives include, for example, silica, metal oxides, fluoropolymers, such as polytetrafluoroethylene (PTFE), and more specifically Boehmite (AlOOH) nanofiber particles obtained from Argonide Corporation, 2 nanometers in diameter and about 100 nanometers in length, and which ALOOH is readily dispersible in a polymeric matrix primarily because of its high surface area and needle like shape; tin oxide, zinc oxide, titanium oxide, copper oxide, alumina, silica, and mixtures thereof, and the like. The aspect ratio of the additives or fillers can vary, and in embodiments this ratio can be in excess of 2, for example from about 2.5 to about 150. Also, the diameter of the additive particles can vary, for example such diameter can be, for example, from about 0.001 to about 1, and more specifically, from about 0.005 to about 0.4 micron. Specific examples of needle shaped additives are Boehmite (AlOOH) obtained from Argonide Corporation (Sanford, Fla.), and of about 2 nanometers in average diameter and an aspect ratio of 100, and titanium oxide MT-150W obtained from Tayca Corporation (Japan), and which has a diameter of about 15 nanometers and an aspect ratio of 5; titanium oxide STR-60N obtained from Sakai Corporation (Japan), and has a diameter of about 15 nanometers and an aspect ratio of 3; titanium oxide FTL-100 obtained from Ishihara Sangyo Kaisha, Ltd. (Japan), and has a diameter of from about 50 to about 100 nanometers and an aspect ratio of from about 30 to about 120; PTFE ZONYL™ TE-3667 obtained from E.I. DuPont (Wilmington, Del.), and which has a diameter of about 100 nanometers and an aspect ratio of 2.5. The synthesis of fiber-like amorphous silica that can be selected as additive filler for the disclosed photoconductors has been reported by Patwardhan et al. (*Journal of Inorganic and Organometallic Polymers,* 2001, volume 11, issue 2, pages 117-121), the disclosure of which is totally incorporated herein by reference.

Moreover, in embodiments the needle shaped particles can be treated with at least one surface component primarily to further assist in the rapid dispersibility thereof. Examples of surface treating components include titanate coupling agents, aluminum coupling agents, zircoaluminate coupling agents, fatty acid salts, silane coupling agents, phosphate, metaphosphates, other known coupling agents, mixtures thereof, and the like, and which components can be selected in amounts, for example, of from about 1 to about 30 weight percent, and more specifically, from about 5 to about 15 weight percent.

Compared with spherical additives, it is believed that needle shaped additives are more easily and uniformly dispersed in a polymeric matrix, which polymeric dispersion comprising needle shaped additives usually exhibits Newtonian or like rheological behavior. A polymeric dispersion comprising spherical additives usually exhibits non-Newtonain Theological behavior, or shear thinning. Photoconductors having uniformly dispersed needle shaped additives on the top surface permit further lifetime improvement over those having spherical additives on the surface. Furthermore, photoconductors having uniformly dispersed needle shaped additives generate images, such as developed xerographic images, with excellent resolution and minimal or no background deposits.

The anticurl back coating layer, when present, comprises at least one polymer, which usually is the same polymer that is selected for the charge transport layers and needle shaped particles as illustrated herein. Examples of polymers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymeric binders are comprised of polycarbonate resins with a molecular weight of from about 20,000 to about 100,000, and more specifically with a molecular weight Mw of from about 50,000 to about 100,000. In various embodiments, the anticurl back coating layer, when present, has a thickness of from about 1 to about 100, from about 5 to about 50, or from about 10 to about 30 microns. The needle shaped additives are present in an amount of, for example, from about 1 to about 30, or from about 5 to about 20 weight percent of the total ACBC layer components.

The thickness of the photoconductor substrate layer depends on many factors, including economical considerations, electrical characteristics, adequate flexibility, and the like, thus this layer may be of a substantial thickness, for example over 3,000 microns, such as from about 1,000 to about 2,000 microns, from about 500 to about 1,000 microns, or from about 300 to about 700 microns (about throughout includes all values in between the values recited), or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of substantial thickness of, for example, up to many centimeters or of a minimum thickness of less than a millimeter. Similarly, a flexible belt may be of substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, arid the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques, such as oven drying, infrared radiation drying, air drying, and the like, such that the final dry thickness of the photogenerating layer is as illustrated herein, and can be, for example, from about 0.01 to about 30 microns after being dried at, for example, about 40° C. to about 150° C. for about 15 to about 90 minutes. More specifically, the photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer, or plurality of charge transport layers are formed on the photogenerating layer. This structure may have the photogenerating layer on top of or below the charge transport layer.

In embodiments, a suitable adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms), and more specifically, from 0.09 to about 0.2 micrometer (microns). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layers for the photoconductors of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer), and the underlying conductive surface of substrate may be selected.

A number of charge transport compounds can be included in the top overcoating layer, in the charge transport layer, and in both the overcoating top layer and the charge transport layer, and where the charge transport layer generally is of a thickness of from about 5 microns to about 75 microns, and more specifically, of a thickness of from about 10 microns to about 40 microns. Examples of charge transport components are aryl amines of the following formulas/structures

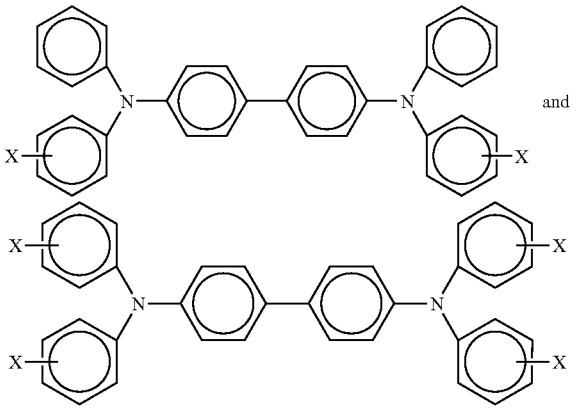

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

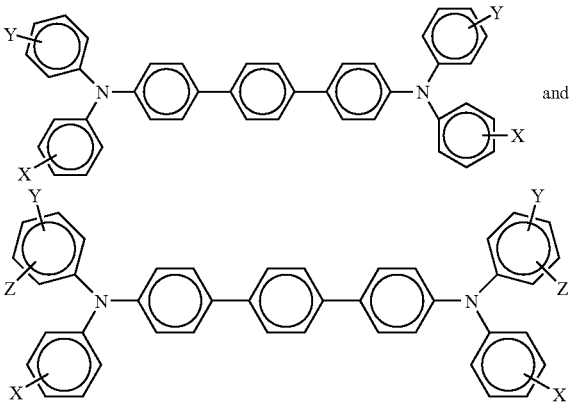

and wherein X, Y and Z are independently alkyl, alkoxy, aryl, a halogen, or mixtures thereof, and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight Mw of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent in the charge transport layer, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers, or at least one charge transport layer or the overcoating layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330,. 425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZIR™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HIP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. The overcoating layer may be applied over the charge transport layer to, for example, provide abrasion protection, and to enable an increase in the photoconductor useful life.

Aspects of the present disclosure relate to a photoconductive imaging member comprised of a supporting substrate, a photogenerating layer, a charge transport layer, and an overcoating layer containing needle shaped particles; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive member comprised of a supporting substrate, thereover a layer comprised of a photogenerating pigment, a charge transport layer or layers, and thereover an overcoating layer that includes therein needle shaped particles, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; a photoconductor wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers comprises

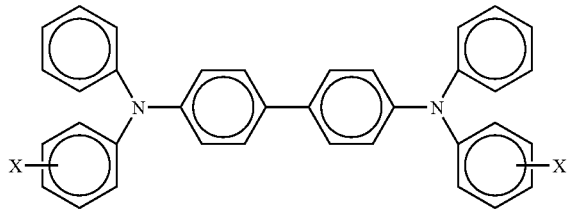

wherein X is selected from the group consisting of alkyl, alkoxy, aryl, and halogen; an imaging member wherein alkyl and alkoxy contain from about 1 to about 12 carbon atoms; a photoconductor wherein alkyl contains from about 1 to about 5 carbon atoms; a photoconductor wherein alkyl is methyl; an imaging member wherein each of or at least one of the charge transport layers comprises

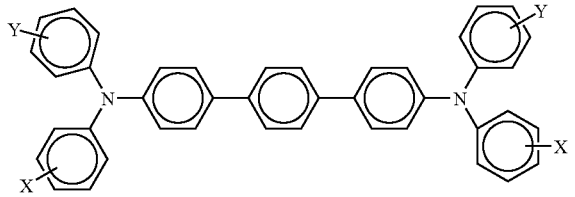

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrenes; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (20±2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer, and a top overcoating layer in contact with the hole transport layer or in embodiments in contact with the photogenerating layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer, and an overcoating protective layer that includes needle shaped particles.

The photoconductors disclosed herein include in embodiments a protective overcoating layer (POC) that includes needle shaped particles, usually in contact with and contiguous to the charge transport layer, which overcoating layer is comprised of, in addition to the needle shaped particles, components that include a polymer and an optional charge transport component.

The photoconductor overcoating layer can be applied by a number of different processes inclusive of dispersing the overcoating composition in a solvent system, and applying the resulting overcoating layer coating solution or dispersion onto the receiving surface, for example, the top charge transport layer of the photoconductor to a thickness of, for example, from about 0.5 micron to about 10 microns, or from 1 micron to about 8 microns.

In embodiments, examples of polymers present, for example, in the overcoating layer include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-2-polycarbonate), poly(4,4'-isopropylidene-3,3'-dimethyl-diphenyl)carbonate (also referred to as bisphenol-C-polycarbonate), and the like. Examples of polymeric binders contained in the overcoating are, for example, comprised of polycarbonate resins with a weight average molecular weight of from about 20,000 to about 100,000, and more specifically, with a molecular weight Mw of from about 50,000 to about 100,000. Examples of the optional charge transport component present in the overcoating layer, the charge transport layer, or both of these layers, include N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-NN'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine molecules.

In another embodiment, this POC layer is comprised, in addition to the needle shaped particles, of components that include (i) an acrylated polyol, and (ii) an alkylene glycol polymer, such as polypropylene glycol where the proportion of the acrylated polyol to the polypropylene glycol is, for example, from about 0.1:0.9 to about 0.9:0.1, at least one transport compound, and at least one crosslinking agent. The overcoat composition can comprise as a first polymer an acrylated polyol with a hydroxyl number of from about 10 to about 20,000; a second polymer of an alkylene glycol with, for example, a weight average molecular weight of from about 100 to about 20,000, a charge transport compound; an acid catalyst, and a crosslinking agent wherein the overcoating layer, which is crosslinked, contains polyols, such as an acrylated polyol and a glycol, a crosslinking agent residue and a catalyst residue, all reacted into a polymeric network. While the percentage of crosslinking can be difficult to determine and not being desired to be limited by theory, the overcoat layer is crosslinked to a suitable value, such as for example, from about 5 to about 50 percent, from about 5 to about 25 percent, from about 10 to about 20 percent, and in embodiments from about 40 to about 65 percent. Excellent photoconductor electrical response can also be achieved when the prepolymer hydroxyl groups, and the hydroxyl groups of the dihydroxy aryl amine (DHTBD) are stoichiometrically less than the available methoxy alkyl on the crosslinking, such as CYMEL® moieties.

According to various embodiments, the crosslinkable polymer present in the overcoat layer can comprise a mixture of a polyol and an acrylated polyol film forming resins, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols, or a polyfunctional polyol with a high hydroxyl number to form a polymer comprising a number of branches off of the main polymer chain. The polyol can possess a hydroxyl number of, for example, from about 10 to about 10,000 and can include ether groups, or can be free of ether groups. Suitable acrylated polyols can be, for example, generated from the reaction products of propylene oxide modified with ethylene oxide, glycols, triglycerol, and the like, and wherein the acrylated polyols can be represented by the following formula (2)

$$[R_t—CH_2]_t—[—CH_2—R_a—CH_2]_p—[—CO—R_b—CO—]_n—[—CH_2—R_c—CH_2]_p—[—CO—R_d—CO—]_q \quad (2)$$

where $R_t$ represents $CH_2CR_1CO_2$—; $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl, or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q=1. Examples of commercial acrylated polyols are JONCRYL™ polymers, available from Johnson Polymers Inc., and POLYCHEM™ polymers, available from OPC polymers.

The overcoating layer includes in embodiments a crosslinking agent and a catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include methylated, butylated melamine-formaldehyde. A nonlimiting example of suitable methoxymethylated melamine compounds can be CYMEL® 303 (available from Cytec Industries), which is a methoxymethylated melamine compound with the formula $(CH_3OCH_2)_6N_3C_3N_3$, and the following structure

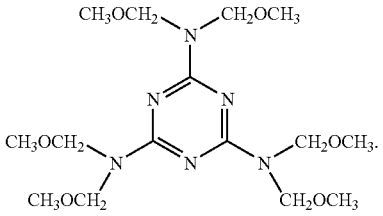

Crosslinking can be accomplished by heating the overcoating components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid, methanesulfonic acid, and the like, and mixtures thereof.

A blocking agent can also be included in the overcoat layer, which agent can "tie up", capture, or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents, such as CYCAT® 4045, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluene sulfonic acid as a catalyst is less than about 140° C., for example 135° C., for about 1 minute to about 40 minutes. A typical concentration of acid catalyst is from about 0.01 to about 5 weight percent based on the weight of polyol/acrylated polyol. After crosslinking, the overcoating should be substantially insoluble in the solvent in which it was soluble prior to crosslinking, thus permitting no overcoating material to be removed when rubbed with a cloth soaked in the solvent. Crosslinking results in the development of a three-dimensional network that restrains the transport molecule in the crosslinked polymer network.

The overcoating layer can also include a charge transport material to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine; an alcohol-soluble dihydroxy TPD, and the like. An example of a terphenyl charge transporting molecule can be represented by the following formula

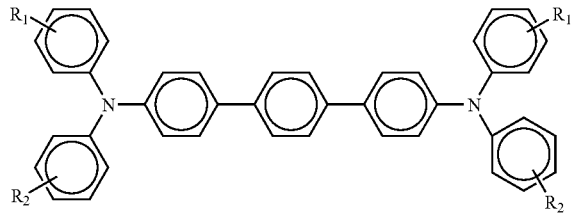

where each $R_1$ is —OH; and $R_2$ is alkyl ($—C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, $—C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoating layer.

Any suitable secondary or tertiary alcohol solvent can be employed for the deposition of the film forming crosslinking polymer composition of the overcoating layer. Typical alcohol solvents include, but are not limited to, for example, tert-butanol, sec-butanol, 2-propanol, 1-methoxy-2-propanol, and the like, and mixtures thereof. Other suitable co-solvents that can be selected for the forming of the overcoating layer such as, for example, tetrahydrofuran, monochlorobenzene, methylene chloride, and mixtures thereof. These co-solvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the crosslinkable polymer, charge transport material, crosslinking agent, acid catalyst, and blocking agent, utilized for the overcoat solution should be soluble or substantially soluble in the solvents or solvents employed for the overcoating layer.

The thickness of the overcoating layer, which can depend upon the abrasiveness of the charging (for example bias charging roll), cleaning (for example blade or web), development (for example brush), transfer (for example bias transfer roll), etc., in the system employed is, for example, from about 1 or about 2 microns up to about 10 or about 15 microns, or more. In various embodiments, the thickness of the overcoat layer can be from about 1 micrometer to about 5 micrometers. Typical application techniques for applying the overcoat layer over the photoconductive layer can include spraying, dip coating, roll coating, wire wound rod coating, and the like. Drying of the deposited overcoat layer can be effected by any suitable conventional technique such as oven drying, infrared radiation drying, air drying, and the like. The dried overcoat layer of this disclosure should transport charges during imaging.

In the dried overcoating layer, the composition can include from about 40 to about 90 percent by weight of a film forming crosslinkable polymer, and from about 60 to about 10 percent by weight of charge transport material. For example, in embodiments, the charge transport material can be incorporated into the overcoating layer in an amount of from about 20 to about 50 percent by weight, and needle shaped particles present in an amount of from about 1 to about 10 weight percent. Although not desiring to be limited by theory, the crosslinking agent can be located in the central region with the polymers like the acrylated polyol, polyalkylene glycol, charge transport component being associated with the crosslinking agent, and extending in embodiments from the central region.

Electron transport components can be included in the photoconductors illustrated herein, and more specifically, such components can be present in the single layered photoconductors, examples of such components being disclosed in copending U.S. application Ser. No. 11/811,548, filed concurrently herewith, the disclosure of which is totally incorporated herein by reference.

The following Examples are being submitted to illustrate embodiments of the present disclosure.

COMPARATIVE EXAMPLE 1

A photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator or an extrusion coater, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator or an extrusion coater, and which adhesive layer contained 0.2 percent by weight, based on the total weight of the solution, of the copolyester adhesive (ARDEL™ D100, available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting photoconductor web was then overcoated with two separate charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top charge transport layer. The charge transport layer solution of the top layer was prepared as described above for the bottom layer. The top layer solution was applied on the above bottom layer of the charge transport layer to form a coating. The resulting photoconductor device containing all of the above layers was annealed at 120° C. in a forced air oven for 1 minute, and thereafter cooled to ambient room temperature, about 23° C. to about 26° C., resulting in a thickness for each of the bottom and top charge transport layers of 14.5 microns. During the coating processes, the humidity was equal to or less than 15 percent.

COMPARATIVE EXAMPLE 2

A photoconductor was prepared by repeating the process of Comparative Example 1 except that there was applied, with a Bird bar, to the top charge transport layer an overcoating layer dispersion, and which dispersion was prepared by ball milling of a mixture of 8.55 grams of MAKROLON® 5705, a known polycarbonate resin having a molecular weight average of from about 50,000 to 100,000, commercially available from Farbenfabriken Bayer A.G., 0.45 gram of grain-like spherical shaped titanium oxide particles TTO-55N, obtained from Ishihara Sangyo Kaisha, Ltd, Japan, which particles were of a diameter of about 30 nanometers, and 91 grams of methylene chloride with 400 grams of 2 millimeter stainless shot in a 250 milliliter glass bottle for at least 24 hours at 200 rpm on a roller. The resultant film was dried in a forced air oven for 1 minute at 120° C. to yield a 3 micron thick overcoat layer, and which overcoat layer was substantially insoluble in methanol or ethanol.

EXAMPLE I

A photoconductor was prepared by repeating the process of Comparative Example 1 except that there was applied, with a Bird bar, to the top charge transport layer an overcoating layer dispersion, and which dispersion was prepared by ball milling of a mixture of 8.55 grams of MAKROLON® 5705, a known polycarbonate resin having a molecular weight average of from about 50,000 to 100,000, commercially available from Farbenfabriken Bayer A.G., 0.45 gram of needle-like titanium oxide particles MT-150W, obtained from Tayca Corporation, Japan, and with a diameter of about 15 nanometers and an aspect ratio of 5, and 91 grams of methylene chloride with 400 grams of 2 millimeter stainless shot in a 250 milliliter glass bottle for at least 24 hours at 200 rpm on a roller. The resultant film was dried in a forced air oven for 1 minute at 120° C. to yield a 3 micron thick overcoat layer, and which overcoat layer was substantially insoluble in methanol or ethanol.

EXAMPLE II

A photoconductor was prepared by repeating the process of Comparative Example 1 except that there was applied, with a Bird bar, to the top charge transport layer an overcoating layer dispersion, and which dispersion was prepared by ball milling of a mixture of 8.55 grams of MAKROLON® 5705, a known polycarbonate resin having a molecular weight average of from about 50,000 to 100,000, commercially available from Farbenfabriken Bayer A.G., 0.45 gram of needle-like Boehmite (AlOOH) particles, obtained from Argonide Corporation (Sanford, Fla.), and of about 2 nanometers in average diameter and an aspect ratio of 100, and 91 grams of methylene chloride with 400 grams of 2 millimeter stainless shot in a 250 milliliter glass bottle for at least 24 hours at 200 rpm on a roller. The resultant film was dried in a forced air oven for 1 minute at 120° C. to yield a 3 micron thick overcoat layer, and which overcoat layer was substantially insoluble in methanol or ethanol.

EXAMPLE III

A photoconductor was prepared by repeating the process of Comparative Example 1 except that there was applied, with a Bird bar, to the top charge transport layer an overcoating layer dispersion, and which dispersion was prepared by ball milling of a mixture of 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-terphenyl-diamine (DHTBD), 1.5 grams of SILCLEAN™ 3700 (a hydroxylated silicone available from BYK-Chemie USA), 5.5 grams of 8 percent p-toluene sulfonic acid in 60 grams of DOWANOL® PM (1-methoxy-2-propanol obtained from the Dow Chemical Company), 0.55 gram of needle-like Boehmite (AlOOH) particles, obtained from Argonide Corporation (Sanford, Fla.), of about 2 nanometers in average diameter and an aspect ratio of 100, with 100 grams of 2-millimeter stainless shot in a 250 milliliter glass bottle for at least 24 hours at 200 rpm on a roller. The resultant film was dried in a forced air oven for 1 minute at 120° C. to yield a 3 micron thick overcoating layer, and which overcoating layer was substantially insoluble in methanol or ethanol.

Rheology Measurements

The preparation of the overcoating layer dispersions were monitored by known rheology methods, which methods indicated that the dispersions with the grain like spherical particles possessed non-Newtonian behavior, as compared to Newtonian behavior, which behavior evidences an excellent dispersion for the dispersions with the needle like particles. Rheological properties were measured at 25° C. with a rheometer using a double-gap measuring system and a controlled shear stress test mode; the instrument used was a Physica LJDS200, Z1 DIN cup, Paar Physica USA. It is believed that a dispersed system exhibiting Newtonain or like rheological behavior indicates, reference the above needle shaped particles, were uniformly dispersed, the particle attained its primary particle size (in embodiments, the smaller and consistent particle size can result in improved mechanical strength characteristics when the weight amount is fixed) with minimal or no aggregation of the particles as compared to spherical shaped particles which tend to aggregate. The above prepared photoconductors containing the needle shaped uniformly dispersed particles on the top surface permit, it is believed, lifetime extensions as compared to that of the photoconductors of the above Comparative Examples containing spherical shaped nonuniformly dispersed or aggregated additives on the surface. Furthermore, photoconductors having uniformly dispersed needle shaped additive particles in the overcoating layer permit, it is believed, excellent image quality in xerographic printing systems, and where there are minimal background deposits.

The rheology of the above Example I overcoating layer dispersion containing needle-shaped titanium oxide particles and Comparative Example 1 was measured as indicated herein above and is summarized in Table 1.

TABLE 1

| | SHEAR RATE (1/s) | | | | |
|---|---|---|---|---|---|
| | 0.01 | 0.1 | 1 | 10 | 100 |
| VISCOSITY (Pa · s) FOR EXAMPLE I | 0.69 | 0.71 | 0.71 | 0.70 | 0.69 |
| VISCOSITY (Pa · S) FOR COMPARATIVE EXAMPLE 2 | 1.02 | 0.85 | 0.72 | 0.59 | 0.45 |

1/s refers to 1/second or $s^{-1}$ or the unit of shear rate;
Pa · s is the unit of viscosity.

The rheology was near Newtonian (viscosity did not substantially change with the shear rate). The overcoating layer dispersion with needle shaped titanium oxide was uniform and stable with almost no aggregates, evidencing that the needle shaped particles were readily dispersed.

As comparison, the rheology of the overcoating layer dispersion of Comparative Example 2, where the dispersion contained grain-like spherical shaped titanium oxide particles, was also measured. This dispersion exhibited shear thinning behaviors (viscosity decreases with increasing shear rate) evidencing that particle aggregations were present, and that the particles were not uniformly dispersed.

The above rhelogical behavior of the overcoating layer dispersion with the needle shaped particles can, it is believed, extend the life of the photoconductor.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, at least one charge transport layer comprised of at least one charge transport component, and an overcoating layer in contact with and contiguous to the top charge transport layer, and which overcoating layer is comprised of needle shaped particles with an aspect ratio of from 2 to about 200, and a diameter of from about 0.001 to about 1 micron, and which overcoating is comprised of an acrylated polyol, a polyalkylene glycol and a crosslinking agent.

2. A photoconductor in accordance with claim 1 wherein said overcoating is comprised of a crosslinked polymeric network of said acrylated polyol and a polyalkylene glycol, and a crosslinking agent, and wherein said needle shaped particles possess an aspect ratio of from about 3 to 150.

3. A photoconductor in accordance with claim 1 wherein said aspect ratio is from about 2.5 to about 100.

4. A photoconductor in accordance with claim 1 wherein said aspect ratio is from about 5 to about 75.

5. A photoconductor in accordance with claim 2 wherein said overcoating layer further contains a charge transport component and a catalyst, and wherein said alkylene of said polyalkylene glycol contains from 1 to about 10 carbon atoms.

6. A photoconductor in accordance with claim 5 wherein the acrylated polyol has a hydroxyl number of from about 10 to about 20,000, and wherein said acrylate polyol, said polyalkylene glycol, and said charge transport component are reacted in the presence of said catalyst to form a crosslinked polymeric network, and wherein said catalyst is an acid catalyst.

7. A photoconductor in accordance with claim 5 wherein the acrylated polyol has a hydroxyl number of from about 500 to about 2,000.

8. A photoconductor in accordance with claim 5 wherein said polyalkylene glycol is a polypropylene glycol which possesses a weight average molecular weight of from about 100 to about 20,000, and wherein said acrylate polyol, said glycol, said crosslinking agent, and said charge transport component are reacted in the presence of said catalyst to form a crosslinked polymeric network.

9. A photoconductor in accordance with claim 5 wherein the weight ratio of said acrylated polyol to said polyalkylene glycol is from about 2:8 to about 8:2 wherein said acrylate polyol, said polyalkylene glycol, said crosslinking agent, and said charge transport component are reacted in the presence of said catalyst resulting in a crosslinked polymeric network containing said acrylate polyol, said polyalkylene glycol, said crosslinking agent, said catalyst, and said charge transport component, and wherein said needle shaped particles are comprised of at least one of silica, alumina, titania, and a polytetrafluoroethylene, and which particles are present in an amount of from about 1 to about 20 weight percent.

10. A photoconductor in accordance with claim 5 wherein the overcoating charge transport component is selected from the group consisting of at least one of (i) a phenolic substituted aromatic amine, and (ii) a primary alcohol substituted aromatic amine.

11. A photoconductor in accordance with claim 5 wherein the overcoating charge transport component is

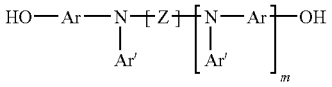

wherein m is 0 or 1; Z is selected from the group consisting of at least one of

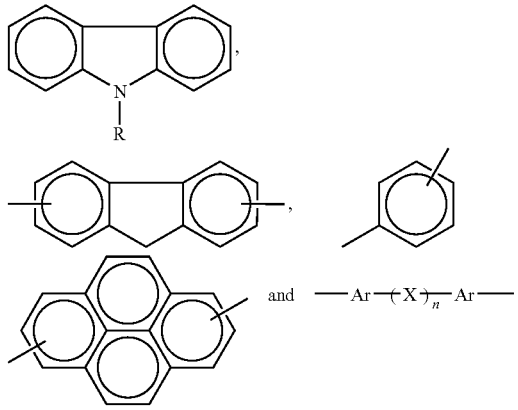

wherein n is 0 or 1; Ar is selected from the group consisting of at least one of

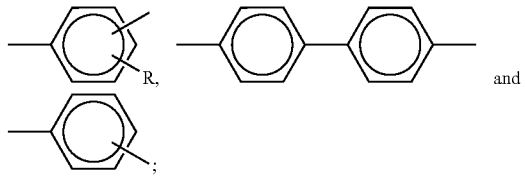

R is selected from the group consisting of at least one of —$CH_3$, —$C_2H_5$, —$C_2H_5$, —$C_3H_7$, and $C_4H_9$; Ar' is selected from the group consisting of at least one of

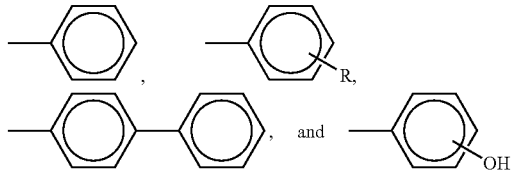

and X is selected from the group consisting of at east one of

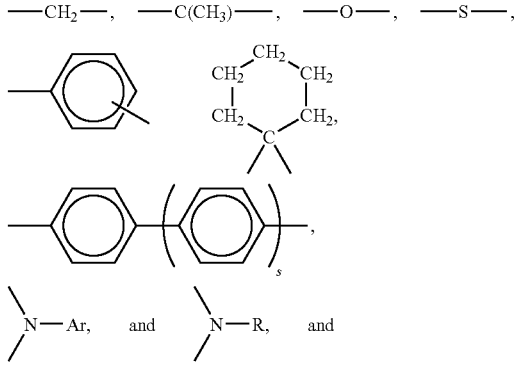

wherein S is 0, 1, or 2, and wherein said needle shaped particles are comprised of at least one of silica, alumina, titania, and a polytetrafluoroethylene.

12. A photoconductor in accordance with claim 5 wherein the crosslinking agent is a methylated butylated melamine formaldehyde, and wherein said needle shaped particles are comprised of at least one of silica, alumina, titania, and a polytetrafluoroethylene, and which filler is present in an amount of from about 1 to about 10 weight percent.

13. A photoconductor in accordance with claim 5 wherein said crosslinking agent is a methoxymethylated melamine compound of the formula $(CH_3OCH_2)_6N_3C_3N_3$.

14. A photoconductor in accordance with claim 5 wherein said crosslinking agent is

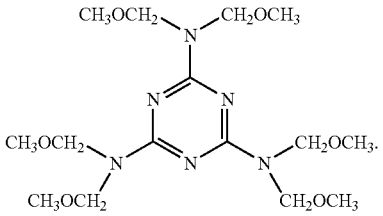

15. A photoconductor in accordance with claim 1 wherein said overcoating further includes a polycarbonate of poly(4,4'-isopropylidene-diphenylene)carbonate, poly(4,4'-cyclohexylidinediphenylene)carbonate, or poly(4,4'-isopropylidene-3,3'-dimethyl-diphenyl)carbonate, and said needle shaped particles are comprised of at least one of silica, alumina, titania, and a polytetrafluoroethylene, and which needle shaped particles are present in an amount of from about 1 to about 20 weight percent.

16. A photoconductor in accordance with claim 5 wherein at least one of said charge transport component and said overcoating charge transport component are comprised of at least one of aryl amine molecules

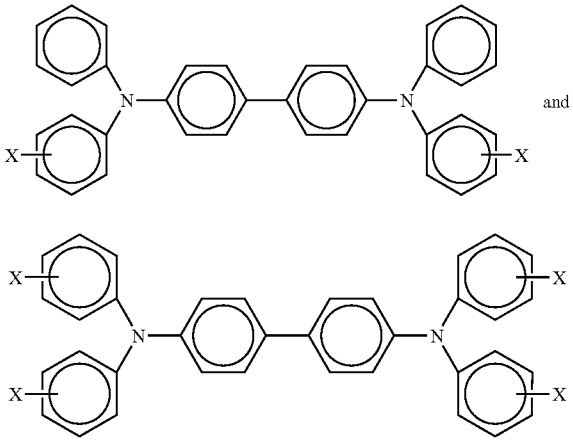

wherein X is selected from the group consisting of at least one of alkyl, alkoxy, aryl, and halogen.

17. A photoconductor in accordance with claim 16 wherein said alkyl and said alkoxy each contains from about 1 to about 12 carbon atoms, and said aryl contains from about 6 to about 36 carbon atoms.

18. A photoconductor in accordance with claim 16 wherein said aryl amine is N,N'-diphenyl-N,N-bis(3-methylphenyl)-1,1'-biphenyl-4,4'-diamine.

19. A photoconductor in accordance with claim 1 wherein said charge transport component is comprised of at least one of aryl amine molecules

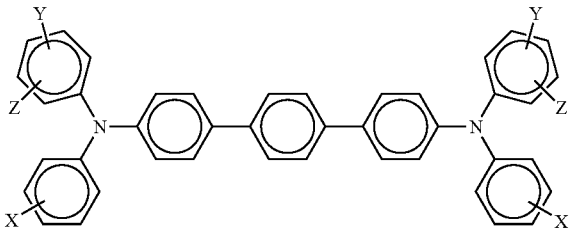

wherein X, Y and Z are independently selected from the group consisting of at least one of alkyl, alkoxy, aryl, and halogen, and wherein at least one of Y and Z are present.

20. A photoconductor in accordance with claim 19 wherein alkyl and alkoxy each contains from about 1 to about 12 carbon atoms, and aryl contains from about 6 to about 36 carbon atoms.

21. A photoconductor in accordance with claim 1 wherein said charge transport component is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

22. A photoconductor in accordance with claim 1 wherein said member further includes in the overcoating layer, or at least one of said charge transport layers an antioxidant comprised of a hindered phenolic, a hindered amine,or mixtures thereof.

23. A photoconductor in accordance with claim 1 wherein said photogenerating layer is comprised of a photogenerating pigment or photogenerating pigments.

24. A photoconductor in accordance with claim 23 wherein said photogenerating pigment is comprised of at least one of a metal phthalocyanine, and a metal free phthalocyanine.

25. A photoconductor in accordance with claim 23 wherein said photogenerating pigment is comprised of a hydroxygallium phthalocyanine.

26. A photoconductor in accordance with claim 1 further including a hole blocking layer, and an adhesive layer.

27. A photoconductor in accordance with claim 1 wherein said at least one charge transport layer is from 1 to about 7 layers.

28. A photoconductor in accordance with claim 1 wherein said at least one charge transport layer is from 1 to about 2 layers.

29. A photoconductor in accordance with claim 1 wherein said at least one charge transport layer is comprised of a top charge transport layer and a bottom charge transport layer, and wherein said top layer is in contact with said bottom layer, and said bottom layer is in contact with said photogenerating layer.

30. A photoconductor comprised in sequence of a supporting substrate, a photogenerating layer thereover, at least one charge transport layer, and an overcoating layer in contact with and contiguous to said charge transport layer, and which overcoating is comprised of a crosslinked polymeric network of an acrylated polyol, a polyalkylene glycol, a crosslinking agent, a charge transport component and needle shaped additive particles substantially free of spherical particles, and which needle shaped particles possess an aspect ratio of from about 3 to about 150, and a diameter of from about 0.001 to about 0.4 micron.

31. A photoconductor in accordance with claim 30 wherein the needle shaped additive is at least one of silica, a metal oxide, and a polytetrafluoroethylene, which additive is present in an amount of from about 1 to about 10 weight percent, and wherein said polyalkylene glycol is a polypropylene glycol, and wherein said diameter is from about 0.005 to about 0.4 micron.

32. A photoconductor in accordance with claim 30 wherein the additive is alumina ($Al_2O_3$), boehmite (AlOOH), or titanium oxide, and which additive is present in an amount of from about 2 to about 10 weight percent, and wherein said alkylene of said polyalkylene contains from 2 to about 6 carbon atoms.

33. A photoconductor comprised in sequence of a supporting substrate, a photogenerating layer thereover, a charge transport layer, a protective overcoating layer in contact with the charge transport layer, and wherein said overcoating layer contains a filler with an aspect ratio of from about 3 to about 125, which filler is of a diameter of from about 0.001 to about 1 micron, and which filler is present in an amount of from about 1 to about 30 weight percent, and wherein said overcoating is comprised of an acrylated polyol, a polyalkylene glycol, a crosslinking agent, and a charge transport component.

* * * * *